US009010160B2

(12) United States Patent
Nieh et al.

(10) Patent No.: US 9,010,160 B2
(45) Date of Patent: Apr. 21, 2015

(54) APPARATUS FOR DEFLECTING A SPRAY OF WASH LIQUID TO A DESIRED LOCATION IN A CLEANING APPLIANCE

(75) Inventors: Jenn-Yeu Nieh, Saint Joseph, MI (US); Matthew Craig Parsons, Dowagiac, MI (US); Jon D. Strait, Saint Joseph, MI (US); Nyik Siong Wong, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1515 days.

(21) Appl. No.: 12/209,398

(22) Filed: Sep. 12, 2008

(65) Prior Publication Data

US 2010/0064444 A1 Mar. 18, 2010

(51) Int. Cl.

| | |
|---|---|
| ***D06F 29/00*** | (2006.01) |
| ***D06F 39/08*** | (2006.01) |
| ***D06F 13/00*** | (2006.01) |
| ***D06F 23/04*** | (2006.01) |

(52) U.S. Cl.

CPC ..... *D06F 39/088* (2013.01); *D06F 13/00* (2013.01); *D06F 23/04* (2013.01)

(58) Field of Classification Search

CPC ..... D06F 39/088
USPC ..... 68/23.5
See application file for complete search history.

(56) References Cited

U.S. PATENT DOCUMENTS

| | | | | |
|---|---|---|---|---|
| 2,168,068 | A | | 8/1939 | Loweke |
| 2,322,559 | A | | 6/1943 | Baird |
| 2,513,844 | A | | 7/1950 | Castner, et al. |
| 2,552,398 | A | | 5/1951 | Briggs |
| 2,588,535 | A | | 3/1952 | Kahn |
| 2,625,031 | A | | 1/1953 | Kreitchman |
| 2,703,974 | A | | 3/1955 | Clark |
| 2,767,022 | A | * | 10/1956 | Kennard et al. ..... 239/434 |
| 2,972,876 | A | | 2/1961 | Geldhof |
| 3,121,317 | A | * | 2/1964 | Toma ..... 68/23.5 |
| 3,335,584 | A | | 8/1967 | Urban |
| 3,742,736 | A | | 7/1973 | Fish et al. |
| 4,000,968 | A | * | 1/1977 | Schrage et al. ..... 8/158 |
| 4,236,320 | A | | 12/1980 | Schwadike et al. |
| 4,303,406 | A | | 12/1981 | Ross |
| 5,031,426 | A | | 7/1991 | Wilson |
| 5,167,722 | A | | 12/1992 | Pastryk et al. |
| 5,562,114 | A | | 10/1996 | St. Martin |
| 5,582,039 | A | | 12/1996 | Mueller et al. |
| 5,657,650 | A | | 8/1997 | Lee et al. |
| 5,768,730 | A | | 6/1998 | Matsumoto et al. |
| 5,823,018 | A | | 10/1998 | Lee |
| 5,937,677 | A | | 8/1999 | Lee |
| 6,185,774 | B1 | | 2/2001 | Tubman |
| 7,263,862 | B2 | | 9/2007 | Lyu et al. |
| 2003/0051514 | A1 | | 3/2003 | Kim et al. |
| 2005/0060813 | A1 | | 3/2005 | Patil et al. |
| 2005/0166644 | A1 | | 8/2005 | Gerald France et al. |
| 2005/0183208 | A1 | | 8/2005 | Scheper et al. |
| 2007/0107471 | A1 | | 5/2007 | Zaccone et al. |

FOREIGN PATENT DOCUMENTS

| | | |
|---|---|---|
| JP | 54007769 | 1/1979 |

* cited by examiner

*Primary Examiner* — David Cormier

(57) ABSTRACT

An apparatus for deflecting a spray of wash liquid to a desired location in either a drum or tub of a cleaning appliance along different flow paths and/or flow patterns according to the velocity of the wash liquid.

27 Claims, 6 Drawing Sheets

APPARATUS FOR DEFLECTING A SPRAY OF WASH LIQUID TO A DESIRED LOCATION IN A CLEANING APPLIANCE

BACKGROUND OF THE INVENTION

Cleaning appliances, an example of which is a clothes washing machine or clothes washer, are used for treating, such as cleaning or refreshing, clothing and other fabric items. Cleaning appliances may have a perforated drum located within an imperforate tub, with the drum being rotatable relative to the tub about a rotational axis that may vary from horizontal to vertical. The fabric load is placed in the drum where a treating chemistry, such as wash liquid, is free to flow between the drum and the tub through the perforations. A dispensing system, such as a wash liquid system, delivers the treating chemistry to one or both of the drum and the tub.

Some dispensing systems for clothes washers, especially those with a generally vertical rotational axis, include a wash liquid dispenser positioned in the tub ring overlying the upper edges of the drum and tub. Such systems suffer in that they dispense from only one point, resulting in the wetting of only the portion of the fabric load beneath the dispensing point.

Some dispensing systems have multiple dispensing locations to more widely wet the fabric load. These dispensing systems suffer in that to function properly they require a relatively high incoming water pressure to supply wash liquid to each dispensing location. When water pressure is relatively low, spray velocity and spray angle of wash liquid at each dispensing location is decreased or reduced and wash liquid may not be sufficiently supplied to each dispensing location to properly wet the fabric load, which may negatively impact cleaning performance.

SUMMARY OF THE INVENTION

The invention relates to an apparatus for deflecting a spray of wash liquid to a desired location in either a drum or tub of a cleaning appliance along different flow paths and/or flow patterns according to the velocity of the wash liquid.

DESCRIPTION OF AN EMBODIMENT OF THE INVENTION

Figure 1:
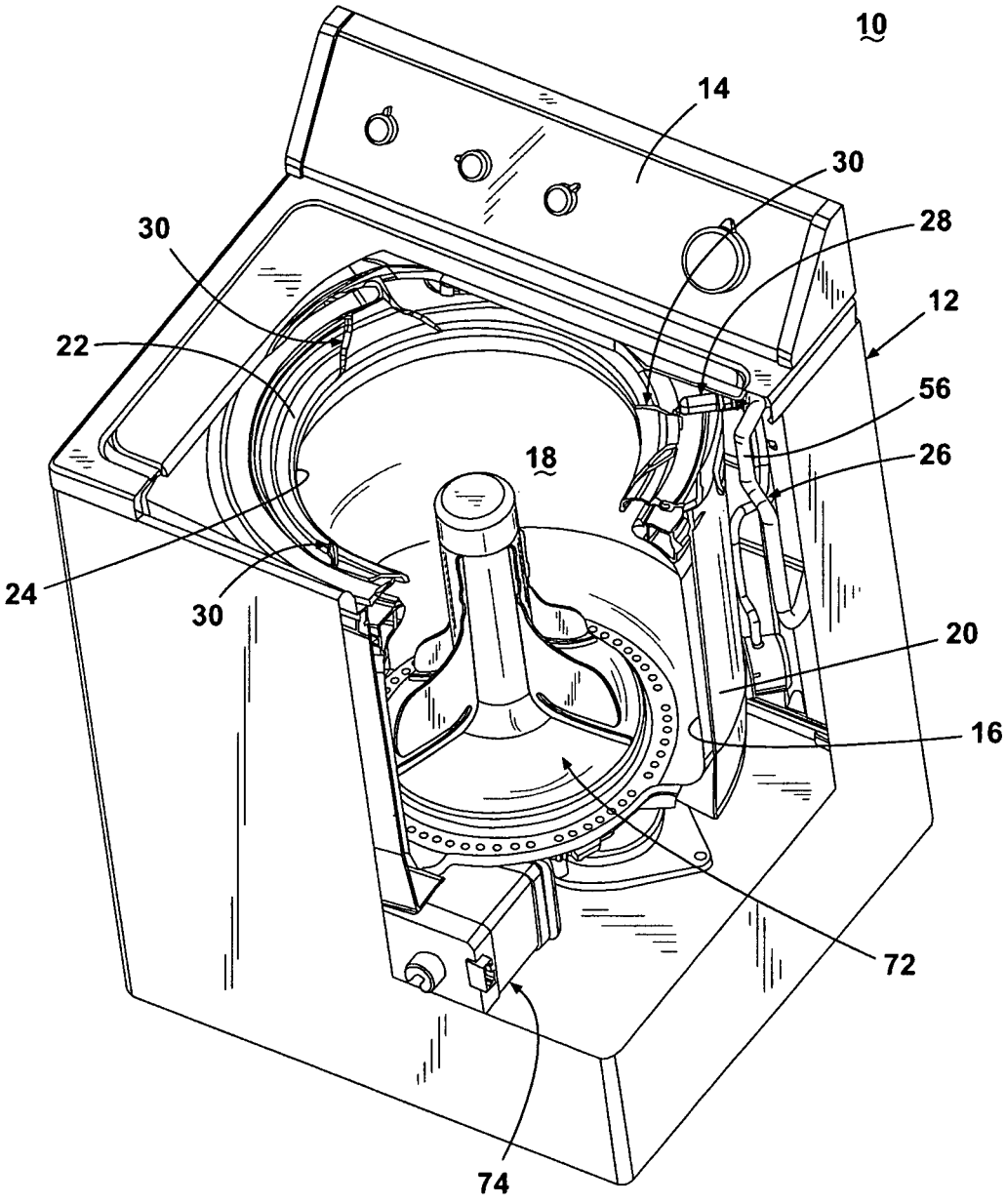
FIG. 1 is a perspective view of a cleaning appliance in the form of a clothes washer having a deflector according to one embodiment of the invention.

Referring now to the figures and particularly to FIG. 1, a cleaning appliance in the form of a vertical axis automatic clothes washing machine or clothes washer 10 defines the environment in which one embodiment of the invention is illustrated. While the invention will be illustrated with respect to a vertical axis washer, other types of clothes washers may be utilized without departing from the scope of the invention. For example, it has been contemplated that the invention has applicability to horizontal axis washers as well as to the vertical axis washers. The invention may also be applicable to other types of cleaning appliances including, without limitation, dryers, refreshers, combination washers and dryers, and non-aqueous appliances.

Further the term wash liquid as used herein is intended to be generic to any type of liquid used in a cleaning appliance. In the case of clothes washers, the wash liquid is historically water or water in combination with other chemistries, such as detergents, rinse agents, fabric softeners, bleach, etc.

The clothes washer 10 may include a cabinet 12 having a controller 14, and enclosing an open top perforated drum 16 that may define a wash chamber 18 sized to receive a fabric load of items to be washed. In the illustrated example, the drum 16 may rotate about a vertical axis. An imperforate tub 20 may be provided to house the drum 16 and holds wash liquid. An annular tub ring 22 may be mounted to the upper edge of the tub 20 within the cabinet 12 to overlie the upper edge of the drum 16 to form an opening 24 into the wash chamber 18. A clothes mover 72 may be mounted within the drum 16 and may rotate relative to the drum 16 and the tub 20. Rotation of the drum 16 and the clothes mover 72 imparts mechanical energy to the wash liquid and to the fabric load to move the fabric items within the wash chamber 18. The exemplary clothes mover 72 may be a conventional dual-action agitator assembly. A variety of other designs for the clothes mover 72 may also be used, including, but not limited to an agitator, with or without an auger, a low profile impeller, and peripheral vanes on the drum 16, or the clothes mover 72 may be omitted altogether without affecting the scope of the invention.

A drive mechanism 74, such as a reversible drive mechanism, may be used to rotate the drum 16 relative to the tub 20. Similarly, the clothes mover 72 may be coupled to the drive mechanism 74 such that the clothes mover 72 can rotate relative to the drum 16 and the tub 20.

A liquid supply system 26, only partially illustrated in FIG. 1, may be coupled with a source of water (not shown) selectively controlled by the controller 14 to fill at least one of the tub 20 and the drum 16 with a predetermined amount of wash liquid to wet the fabric load according to a cleaning cycle run by the controller 14, which may include partially or completely submerging the fabric load. The liquid supply system 26 may include a wash liquid dispenser 28 for controlling the area in which the supplied wash liquid is introduced into at least one of the tub 20 and the drum 16. The liquid supply system 26 may further include at least one deflector 30 for deflecting wash liquid emitted from the wash liquid dispenser 28 into at least one of the drum 16 and the tub 20.

Figure 3:
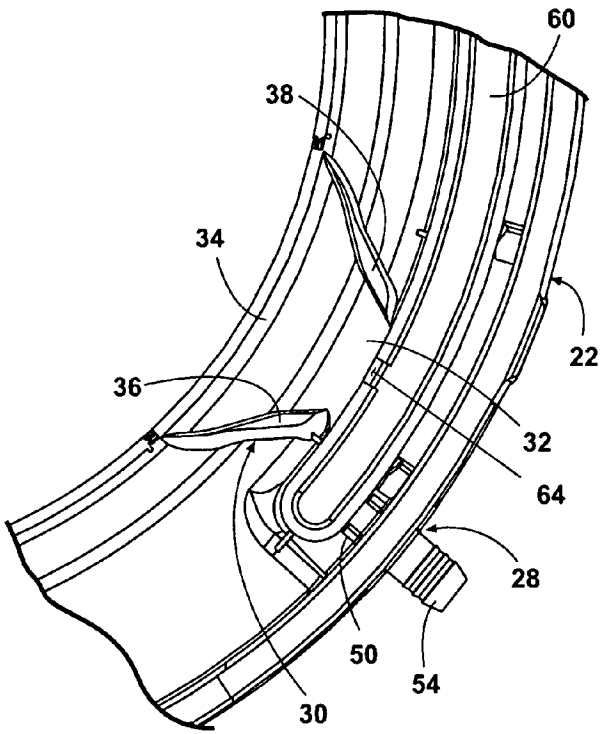
FIG. 3 is a bottom view of the deflector from FIG. 2.
Figure 2:
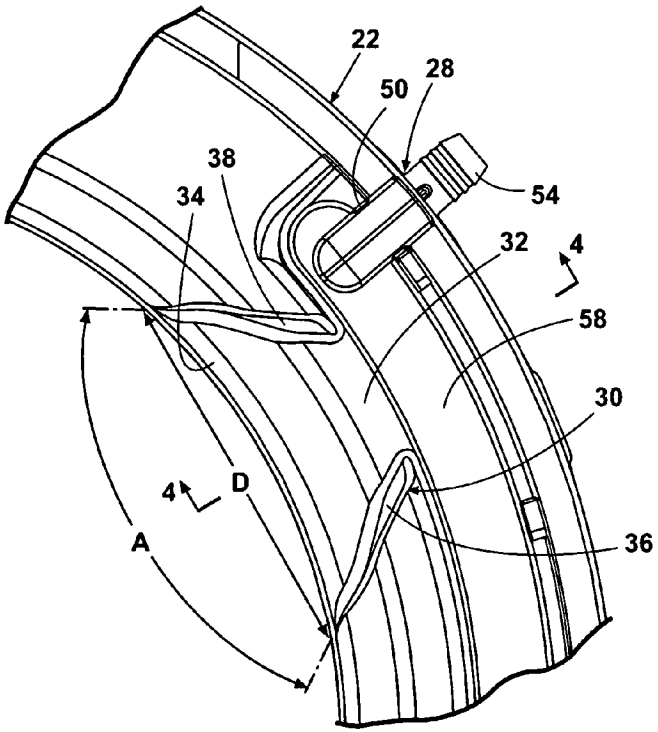
FIG. 2 is a top view of the deflector from FIG. 1.

A top and bottom view of the deflector 30 is shown in FIGS. 2 and 3. The deflector 30 may be positioned at the inner periphery of the tub ring 22. As illustrated herein, the at least one deflector 30 may be integrally formed with the tub ring 22. The deflector 30 may include an upper wall 32 joined to a curved front wall 34, side walls 36, 38 (FIG. 2) enclosing the upper and front walls 32, 34, and may be open at the rear to the orifice 64. The front wall 34 may include an outer surface 42 and an inner deflecting surface 44 and may be curved or divided into two generally linear segments, a first angled section 48 and a second angled section 46 that is joined to the upper wall 32 by the first angled section 48. The second angled section 46 may be oriented at a steeper angle than the first angled section 48. There may be a gentle transition between the first and second angled sections 48, 46 to avoid loss of water adhesion along the inner deflecting surface 44. The first angled section 48 may be oriented to avoid back-splashing when wash liquid strikes the deflector 30. It has been found that orienting the first angled section 48 at approximately 30° from horizontal can avoid back-splashing. The second angled section 46 may be oriented at an angle that will direct a stream of wash liquid toward the drum 16.

The side walls 36, 38 of the deflector 30 may be flared outwardly with respect to each other. At their outermost extends, the side walls 36, 38 are separated by a distance D that defines, together with the relative angles at which the side walls 36, 38 are disposed, a maximum spray angle A for wash liquid directed into the drum 16 or tub 20 by the deflector 30.

Figure 4:
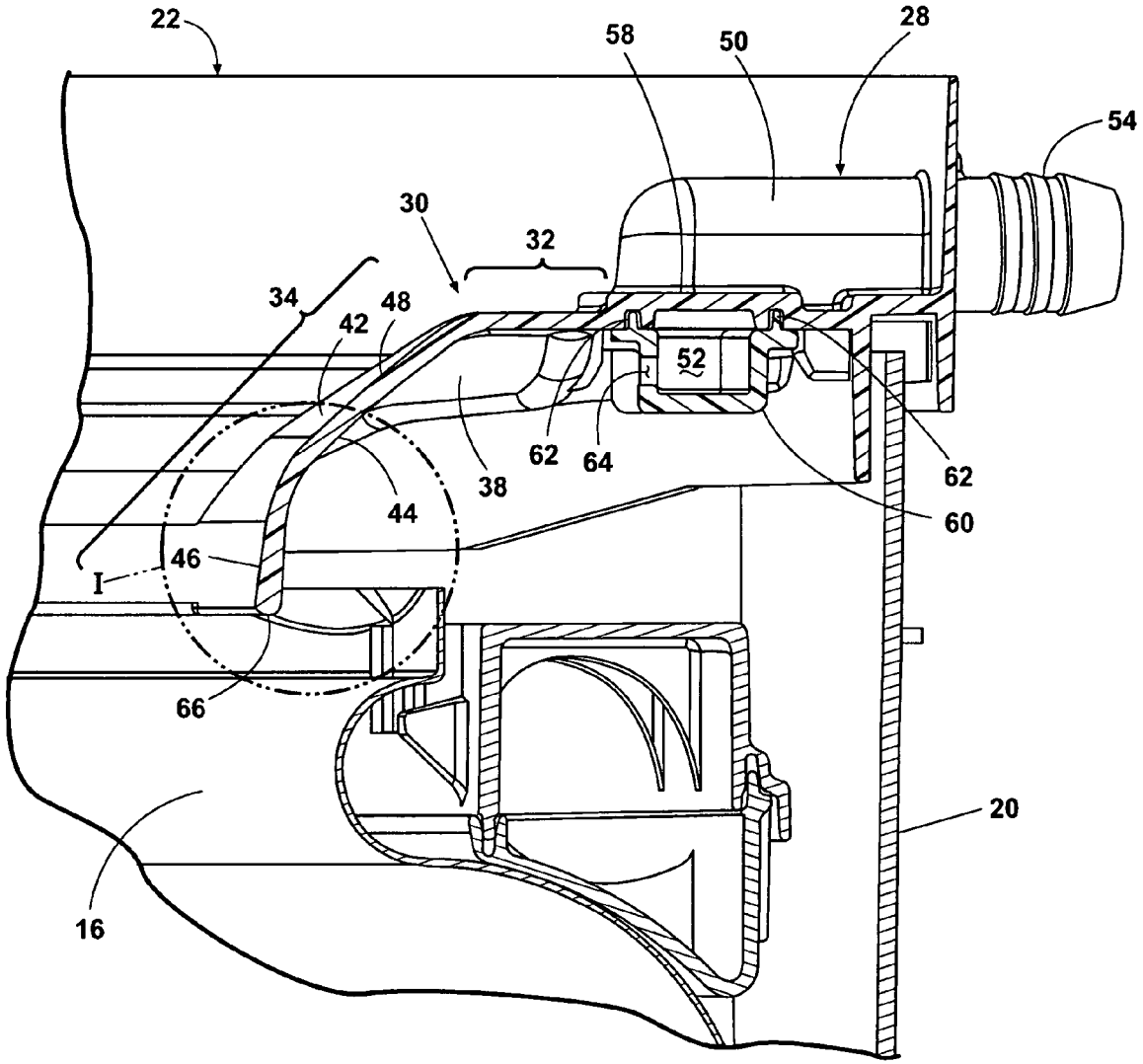
FIG. 4 is a sectional view through line 4-4 of FIG. 2.

As illustrated in FIG. 4, the wash liquid dispenser 28 may be integrally formed with the tub ring 22 and includes an inlet passage 50 extending through an outer side wall of the tub ring 22 and a wash liquid channel 52 that extends around the periphery of the tub ring 22 and supplies wash liquid from the inlet passage 50 to the deflector 30. The inlet passage 50 may be provided with a coupler end 54 that extends outwardly from the tub ring 22 and which may be coupled with a wash liquid supply hose 56 (FIG. 1) of the liquid supply system 26. The wash liquid channel 52 may be defined by an upper channel portion 58 that may be integrally formed with the tub ring 22 and a semicircular lower channel portion 60 that may be coupled with the tub ring 22. As illustrated, the lower channel portion 60 may be a header hermetically sealed to the upper channel portion 58 by welded joints 62.

The lower channel portion 60 includes at least one orifice 64 adjacent each deflector 30. More specifically, the orifice 64 may be in opposing relation with the first angled section 48 of the deflector 30. The orifice 64 restricts the flow of wash liquid out of the wash liquid channel 52 to create a pressurized stream of wash liquid that typically strikes the first angled section 48 and is directed toward the inner deflecting surface 44 of the deflector 30. The orifice 64 may be approximately 4 mm in diameter.

The deflector 30 may have a shape that provides at least two distinct flow paths for wash liquid in response to the velocity of wash liquid emitted from the orifice 64, which is ultimately dependent on the water pressure of the household in which the clothes washer 10 resides. That is, the orifice 64 is exposed to ambient pressure whereas the wash liquid is supplied to the orifice 64 generally at the pressure of the household water supply. The difference in the household water supply pressure and ambient pressure creates a pressure differential that forces the wash liquid out the orifice 64. The greater the pressure differential, the greater will be the dynamic pressure of the fluid, resulting in an increase in the exit velocity of the wash liquid. Because the variation in the ambient pressure is negligible compared to the variation in the household water supply, any increase/decrease in the household water supply pressure generates a corresponding increase/decrease in the velocity of the wash liquid leaving the orifice 64.

The contour of the deflecting surface 44 can be configured to be responsive to the velocity of wash liquid emitted from the orifice 64. As illustrated, one suitable shape for the deflector 30 that provides at least two distinct flow paths is the first and second angled sections 48, 46.

Figure 4A:
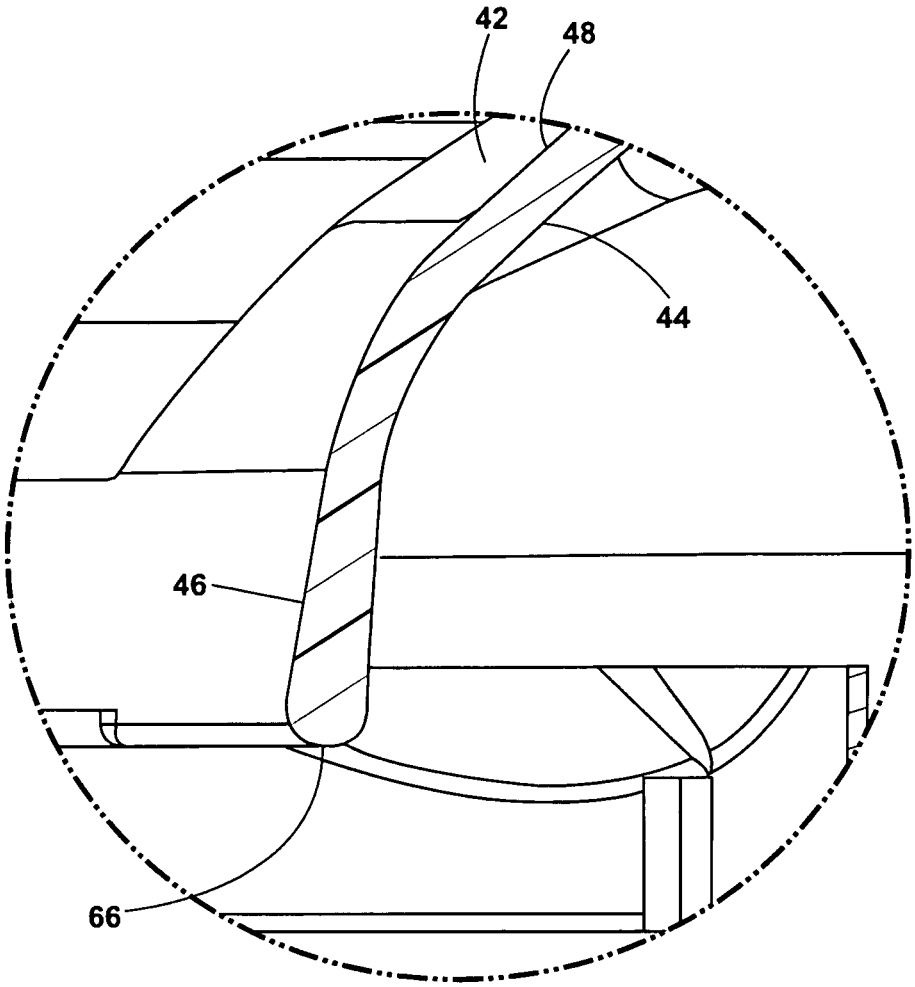
FIG. 4A is a close-up view of area I from FIG. 4 illustrating an outlet tip of the deflector.

FIG. 4A is a close-up view of area I of FIG. 4, illustrating an outlet tip 66 of the deflector 30. The second angled section 46 may include the outlet tip 66, which may have a geometry that provides the at least two distinct flow paths for wash liquid in response to the velocity of wash liquid emitted from the orifice 64 (FIG. 4). As illustrated, one suitable geometry for the tip 66 that provides at least two distinct flow paths is a radius or curvature on the tip 66 when viewed in cross-section so that the tip 66 is rounded. It has been found that a rounded tip 66 with a diameter of approximately 3.8 mm is suitable to provide at least two different velocity-responsive flow paths for wash liquid. Another suitable geometry is a tip 66 having a tear-drop shape when viewed in cross-section.

Figure 5:
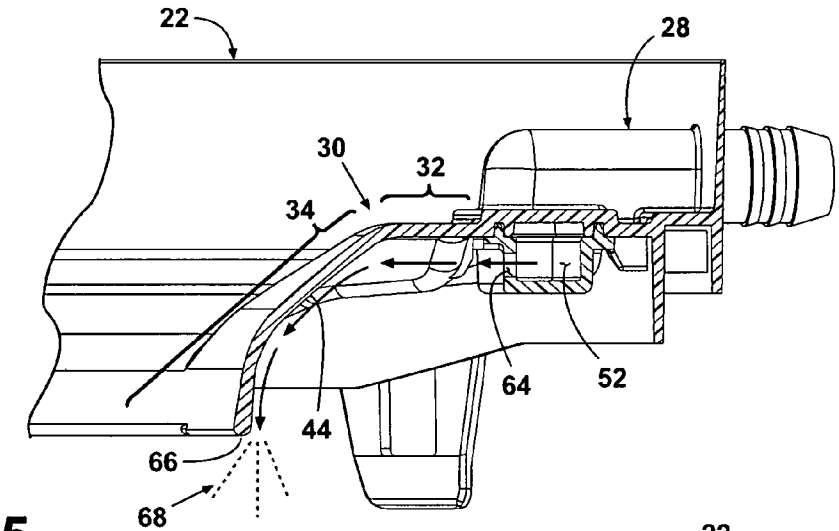
FIG. 5 is a sectional view similar to FIG. 4 illustrating the flow of wash liquid into the clothes washer at a higher household water pressure condition according to one embodiment of the invention.
Figure 6:
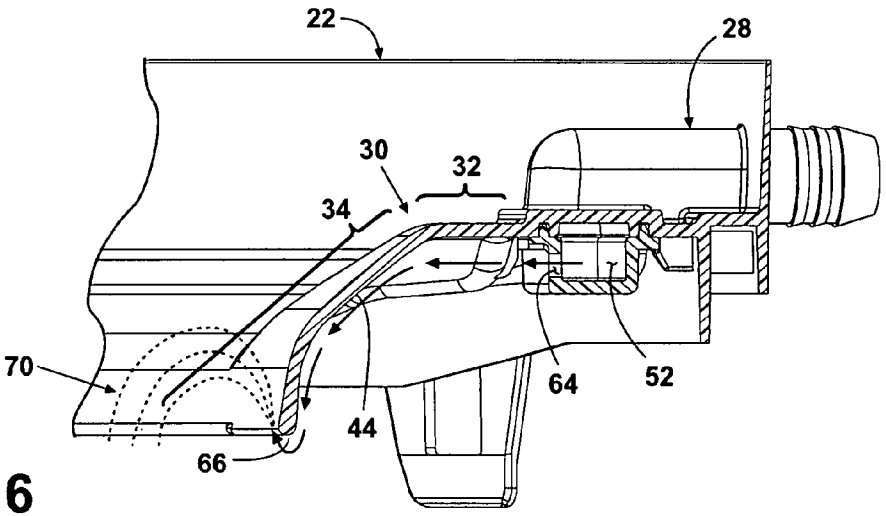
FIG. 6 is a sectional view similar to FIG. 4, illustrating the flow of wash liquid into the clothes washer at a lower household water pressure condition according to one embodiment of the invention.

Two examples of velocity-responsive flow paths for wash liquid are illustrated in FIGS. 5 and 6. A first flow path, shown in FIG. 5, projects generally downwardly from the deflector 30 and corresponds to a higher household water pressure than what is disclosed in FIG. 6. The higher household water pressure may be the standard or anticipated household water pressure, which, for the United States, is typically 30 to 70 psi. The stream of wash liquid emitted from the orifice 64 flows along the front wall 34, spreading out over the inner deflecting surface 44 between the side walls 36, 38. The momentum of the stream of wash liquid forces the wash liquid to flow along the contour of the deflector 30. The surface tension between wash liquid and the deflector 30 balances with the stream's inertia to determine where the water stream separates from the deflector 30. At a higher household water pressure, the stream of wash liquid separates from the deflector 30 at the tip 66 in a fan-like pattern 68 to fall into the drum 16 or tub 20 and will not continue around to the outer surface of the tip 66 due to the momentum of the stream of wash liquid. In general, at a higher household water pressure, wash liquid may be dispensed at a wider spray angle A than for a lower household water pressure.

A second flow path, shown in FIG. 6, initially projects generally forwardly from the deflector 30 and corresponds to a lower household water pressure. The stream of wash liquid emitted from the orifice 64 flows along the front wall 34, spreading out over the inner deflecting surface 44. Since the surface tension between wash liquid and the deflector 30 remains the same, but the stream of wash liquid has less momentum due to the lower pressure, the stream of wash liquid will flow around the tip 66 and separate from the outer surface 42 of the deflector 30 in a fountain-like pattern 70 to fall into the drum 16 or tub 20. Due to the lower household water pressure, wash liquid may not spread out over the inner deflecting surface 44 as far as is does under higher household water pressure conditions. However, due to the shape of the tip 66, even at a lower household water pressure, the wash liquid spreading out over the inner deflecting surface 44 of the deflector will flow upward at the tip 66 due to adhesion attributed to the Coanda effect.

The fountain-like pattern 70 is created by the wash liquid flowing around the tip 66 and upward along the outer surface 42 until it separates from the deflector 30 and is directed forwardly there from by its own momentum, forwardly being defined in a direction of the flow of wash liquid emitted from the orifice 64. Wash liquid thus cascades upwardly and outwardly from the tip 66 of the deflector 30. The radius of the deflector tip 66 and the contour of the deflecting surface 44 will determine the trajectory of the fountain-like pattern 70. The fountain-like pattern 70 may have different configurations which are dependent on the shape of the deflector 30 and the household water pressure, both of which affect the location at which the stream of wash liquid separates from the deflector 30. As illustrated, the fountain-like pattern 70 includes multiple discrete streams of wash liquid extending outward from the tip 66 in a curving trajectory. Alternately, the fountain-like pattern 70 may include one discrete stream of wash liquid and may have different trajectories of varying heights and lengths. For example, a larger tip radius will allow the stream of wash liquid to follow the tip surface and will result in a fountain-like pattern 70 having a higher and/or longer trajectory, while a smaller tip radius will not allow the stream of wash liquid to follow the tip surface and will result in a fountain-like pattern 70 having a lower and/or shorter trajectory. The particular shape or geometry of the deflector 30 may be anything that results in the Conada effect controlling one of the velocity-responsive flow paths to direct the water forward.

Figure 7:
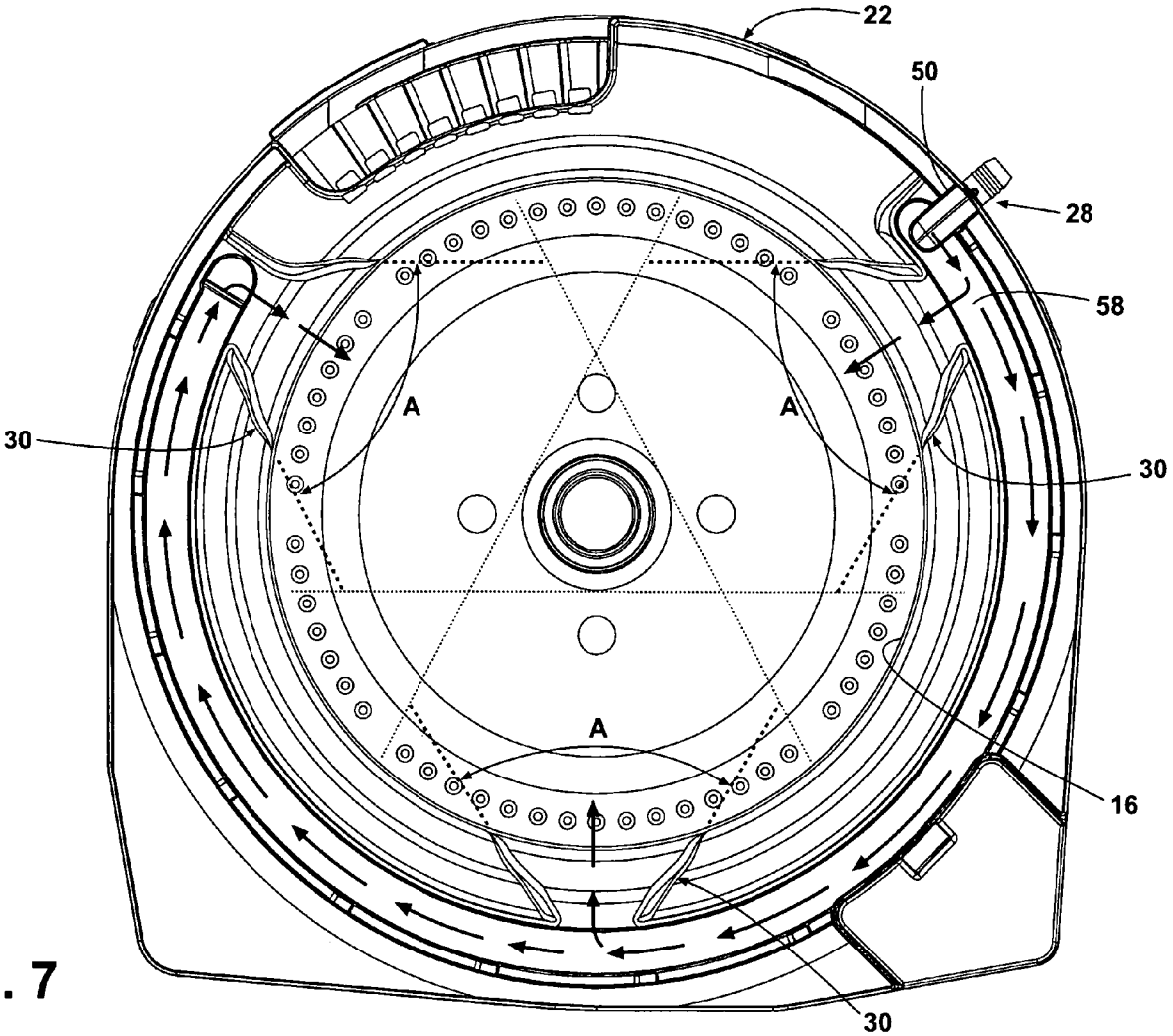
FIG. 7 is a top view of the clothes washing machine from FIG. 1, illustrating the wetting area from the flow of water through the tub ring and into the clothes washer according to one embodiment of the invention.

Referring to FIG. 7, the tub ring 26 may have multiple deflectors 30 for evenly deflecting wash liquid into the drum 16 or tub 20 and the lower channel portion 60 may be provided with an orifice 64 adjacent each deflector 30. As illustrated, the tub ring 26 includes three deflectors 30 generally evenly spaced around the perimeter of the tub ring 26. By providing multiple deflectors 30, spray coverage of the fabric load within the drum 16 may be improved. The number of deflectors 30 may be selected such that they cover the entire all or a portion of the basket as desired. Whether at a higher household water pressure condition or a lower household water pressure condition, by appropriate selection of the geometry of the deflector 30, the fan-like pattern 68 (FIG. 5) and the fountain-like pattern 70 (FIG. 6) cover substantially the same area in the drum. While the flow rates differ, with the fan-like pattern 68 having a greater flow rate than the fountain-like pattern 70, both patterns may spray substantially the same physical area in the one of the tub or drum. While both patterns do not cover the same exact physical area, the areas are similar enough for the purposes required for proper wetting of the fabric load. Therefore, to obtain substantially equivalent wetting, the spraying using the fountain-like pattern 70 may need to be longer than the fan-like pattern 68.

In operation, wash liquid is supplied to the wash liquid dispenser 28 by the liquid supply system 26 (FIG. 1) and enters the wash liquid channel 52 through the inlet passage 50. Wash liquid flows along the channel 52 and a portion of the wash liquid is emitted from the channel 52 as a pressurized stream through each orifice 64. At higher household water pressure conditions wash liquid will be emitted at a higher pressure, while at lower household water pressure conditions wash liquid will be emitted at a lower pressure. The stream of wash liquid strikes the deflector 30 and is deflected into one of the drum 16 and the tub 20. At higher household water pressure conditions, the wash liquid will be deflected substantially along the flow path shown in FIG. 5 and will be dispensed in a fan-like pattern 68. At lower household water pressure conditions, the wash liquid will be deflected substantially along the flow path shown in FIG. 6 and will be dispensed in a fountain-like pattern 70 due to the shape of the tip 66.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A cleaning appliance comprising:

a wash chamber for holding items to be washed;

a wash liquid dispenser having an outlet for emitting wash liquid; and at least one deflector located to deflect the wash liquid emitted from the outlet into the wash chamber, and comprising:

an outer surface; and a deflecting surface opposite the outer surface comprising:

a laterally planar first section in axially opposing relation to the outlet; and a laterally planar second section below the outlet and which terminates in a rounded tip having a tear-drop shape;

wherein the first section is oriented at a first angle and the second section is oriented at a second angle that is different than the first angle, and an intersection of the first and second sections forms an obtuse angle; and wherein the outer and deflecting surfaces merge toward each other in a direction away from the rounded tip to define the tear-drop shape.

2. The cleaning appliance according to claim 1 wherein the second section is oriented at a steeper angle than the first section.

3. The cleaning appliance according to claim 1 wherein the at least one deflector comprises multiple deflectors disposed around the wash chamber.

4. The cleaning appliance according to claim 1 wherein the first section and the second section are joined by a transition section which is configured to maintain liquid adhesion along the deflecting surface.

5. The cleaning appliance according to claim 1 wherein the deflecting surface comprises an uninterrupted deflecting surface.

6. The cleaning appliance according to claim 1 wherein the deflecting surface comprises a laterally uninterrupted deflecting surface.

7. The cleaning appliance according to claim 1 wherein wash liquid emitted at a first velocity flows along the deflecting surface and separates from the deflector at the tip in a fan-like pattern, and wash liquid emitted at a second velocity, less than the first velocity, flows along the deflecting surface around the tip wherein it separates from the deflector in a fountain-like pattern.

8. The cleaning appliance according to claim 7 wherein the fan-like pattern comprises wash liquid moving downwardly from the detecting surface.

9. The cleaning appliance according to claim 7 wherein the fountain-like pattern comprises wash liquid moving upwardly and outwardly from the outer surface.

10. The cleaning appliance according to claim 1 and further comprising a tub for holding wash liquid and a drum located within the tub and defining the wash chamber.

11. The cleaning appliance according to claim 10 wherein the drum rotates about a vertical axis of rotation.

12. The cleaning appliance according to claim 10 and further comprising a tub ring carried by the tub and defining an opening into the drum and the at least one deflector is provided on the tub ring.

13. The cleaning appliance according to claim 12 wherein the at least one deflector is formed in the tub ring.

14. The cleaning appliance according to claim 12 wherein the wash liquid dispenser comprises a header with at least one orifice aligned with the at least one deflector and defining the outlet.

15. The cleaning appliance according to claim 1, wherein the at least one deflector comprises a shape wherein wash liquid emitted at a first velocity separates from the deflector at a first location and wash liquid emitted at a second velocity, less than the first velocity, separates from the deflector at a second location.

16. The cleaning appliance according to claim 15 wherein the first location comprises the deflecting surface of the at least one deflector.

17. The cleaning appliance according to claim 15 wherein the second location comprises the outer surface of the at least one deflector.

18. A cleaning appliance comprising:

a tub for holding wash liquid;

a drum located within the tub and defining a wash chamber for holding items to be washed;

a wash liquid dispenser having an outlet for emitting wash liquid; and at least one deflector located to deflect the wash liquid emitted from the outlet into the wash chamber, and comprising:

an outer surface; and a deflecting surface opposite the outer surface comprising:

a first angled section in axially opposing relation to the outlet; and a second angled section below the outlet and which terminates in a rounded tip having a tear-drop shape;

wherein the first angled section is oriented at a first angle and the second angled section is oriented at a second angle that is steeper than the first angle, and an intersection of the first and second angled sections forms an obtuse angle; and wherein the outer and deflecting surfaces merge toward each other in a direction away from the rounded tip to define the tear-drop shape.

19. The cleaning appliance according to claim 18, wherein the at least one deflector comprises a shape to provide at least two distinct flow paths in response to the velocity of the emitted wash liquid, with a first flow path projecting downwardly from the deflector and a second flow path projecting forwardly from the deflector.

20. The cleaning appliance according to claim 19 wherein the shape comprises the tip having a geometry that provides at least one of the at least two distinct flow paths.

21. The cleaning appliance according to claim 19 wherein the first flow path generates a fan-like pattern.

22. The cleaning appliance according to claim 19 wherein the second flow path generates a fountain-like pattern.

23. The cleaning appliance according to claim 18 wherein the drum rotates about a vertical axis of rotation.

24. The cleaning appliance according to claim 18 and further comprising a tub ring carried by the tub and defining an opening into the drum and the at least one deflector is carried by the tub ring.

25. The cleaning appliance according to claim 24 wherein the at least one deflector is formed in the tub ring.

26. The cleaning appliance according to claim 24 wherein the wash liquid dispenser comprises a header with at least one orifice aligned with the at least one deflector and defining the outlet.

27. The cleaning appliance according to claim 18 wherein the at least one deflector comprises multiple deflectors disposed around the wash chamber.

* * * * *